United States Patent [19]

Sasaki

[11] 4,277,068

[45] Jul. 7, 1981

[54] DISK PROJECTOR AND CATCHER

[75] Inventor: Sei'ichi Sasaki, Goseshi, Japan

[73] Assignee: Kabushiki Kaisha Keiheisha, Japan

[21] Appl. No.: 82,819

[22] Filed: Oct. 9, 1979

[30] Foreign Application Priority Data

Mar. 30, 1979 [JP] Japan ..... 54-42404[U]

[51] Int. Cl.[3] ..... A63B 65/10

[52] U.S. Cl. ..... 273/324; 124/10

[58] Field of Search ..... 273/328, 324; 124/10

[56] References Cited

U.S. PATENT DOCUMENTS

| | | | |
|---|---|---|---|
| 3,487,824 | 1/1970 | Profitt | 124/10 |
| 4,145,050 | 3/1979 | Sullivan et al. | 273/322 |
| 4,165,580 | 8/1979 | Muira | 46/74 R |

FOREIGN PATENT DOCUMENTS

| | | | |
|---|---|---|---|
| 543988 | 6/1922 | France | 124/10 |
| 1081204 | 6/1954 | France | 124/10 |
| 597682 | of 0000 | United Kingdom | 273/324 |
| 745610 | of 0000 | United Kingdom . | |
| 1320091 | of 0000 | United Kingdom | 273/324 |
| 1548728 | of 0000 | United Kingdom . | |

*Primary Examiner*—Anton O. Oechsle

*Attorney, Agent, or Firm*—Eyre, Mann, Lucas & Just

[57] ABSTRACT

A flying saucer toy consisting of a pistol and a flying disk fired from said pistol, wherein the pistol includes a pair of resilient pinching blades between which the flying disk is loaded, one pinching blade having an opposing corner while the other having a slippery corner, a thrust provided by the pinching blades to the disk being transformed into a torque between the opposing and slippery corners, the pistol further including a landing spot for allowing a flying disk to land thereon during its flight, the flying disk having an inwardly concave bottom adapted to receive a lift efficiently.

6 Claims, 6 Drawing Figures

FIG. 2
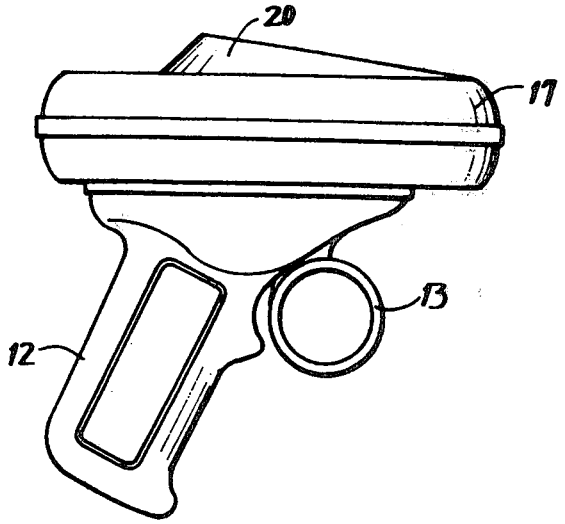
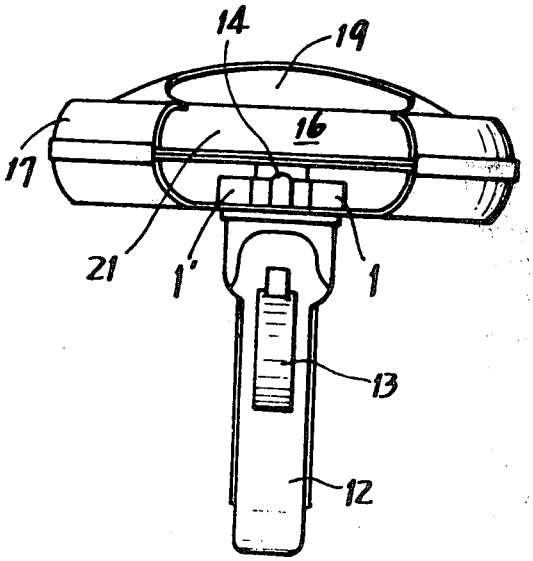
FIG. 3

FIG. 5
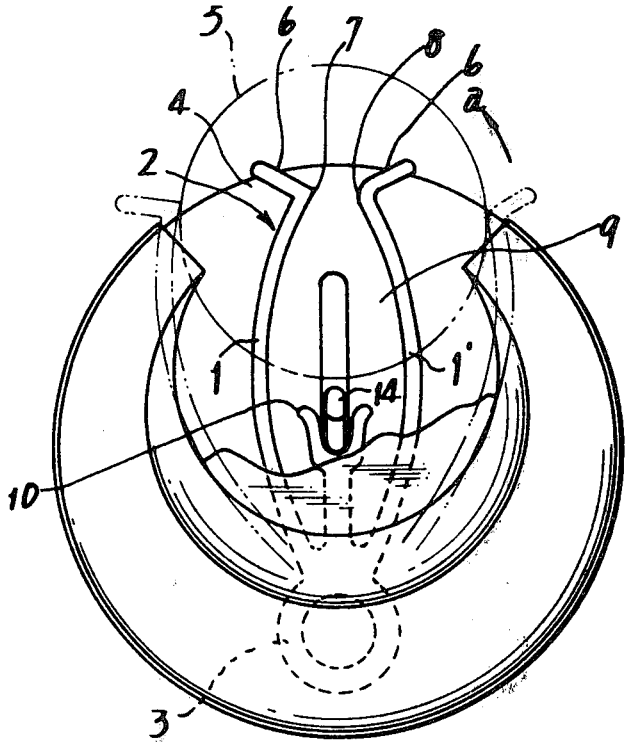
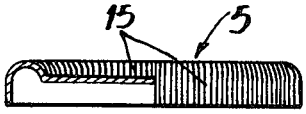
FIG. 6

DISK PROJECTOR AND CATCHER

BACKGROUND OF THE INVENTION

1. Field of the Invention

This invention relates to a flying saucer toy consisting a pistol and a flying disk, wherein the flying disk is not only fired from the pistol but also can be landed thereon. More particularly, the invention relates to a pistol for firing a flying saucer in an aimed direction over a relatively long distance during which the flying disk can be caught in the pistol, wherein the flying disk has an inwardly concave bottom so as to receive a lift efficiently.

2. Description of the Prior Art

A flying disk or saucer having a concave bottom is known and popular among children; one of the examples is known as "Frisbee". However, such known flying disks must be projected directly by hand or by means of a suitable projector operated by hand. In either case a high degree of skill is required to fly it, particularly to manoeuvre it in a desired direction over a relatively long distance. Owning to this difficulty, children, especially infants, cannot play with them. In the case of "Frisbee" or any other known flying disk, it may be true that the operator feels excitement and enjoyment when he throws it with his determination for its successful flight, but the excitement and enjoyment are limited to his personal experience, not shared by other people. Other people are only bystanders, who have to watch the disk fly and wait for it to return to the ground. The operator's happy feeling cannot be shared by others until they themselves try the play.

In order to overcome the difficulty of throwing a flying disk, a variety of firing tools or pistols have been developed, but the common disadvantage is that the mechanism is complicated and accordingly costly. The complicated mechanism is involved in imparting torque as well as thrust to the flying disk at the moment of firing. In addition, the known pistols are only intended to fire a flying disk, and has no provision of a landing facility in which the flying disk is caught during its flight. In general, if the pistol has two-fold functions of firing and catching, not only the operator but also other people can enjoy the play together, wherein each has a pistol in his hand. A new play will start from a catcher. In this way all people can participate in the play, and their enjoyment will be multiplied.

It is a principal object of the present invention to provide an improved flying saucer toy consisting of a pistol and a flying disk, wherein the pistol not only fires said flying disk but also can catch same during its flight.

It is another object of the present invention to provide an improved flying saucer toy which is easily operated by children and infants.

Other objects and advantages of the present invention will be obvious to one skilled in the art from the following description of the invention.

SUMMARY OF THE INVENTION

According to the present invention, the flying saucer toy includes a pistol for firing a flying disk, wherein the pistol includes a pair of resilient pinching blades adapted to hold said disk therebetween under compression, one pinching blade having an opposing corner adjacent the free end thereof while the other blade has a slippery corner adjacent the free end thereof, said opposing corner and said slippery corner being oppositely located, said opposing corner being adapted for impeding travel of the disk to resist a thrust provided by said pinching blades to said disk while said slippery corner is adapted to allow the disk to pass easily, thereby enabling a torque to to be exerted on said disk during a firing impetus, said pistol further including a pocket defined by a side wall in which said flying disk can be caught during its flight, said flying disk being provided with an inwardly concave bottom adapted to receive a lift efficiently.

For example, in the embodiment shown, the rim of the disk has ridges thereon which are engaged by the opposing corner during a firing impetus to retard the forward motion or thrust of the disk on the rim of the disk adjacent to the opposing corner while the oppositely positioned slippery corner allows the rim of the disk to easily slide by. The unbalanced application of thrust along the periphery of the disk imparts a torque to the disk as it is being fired.

The invention will be more particularly described by way of example with reference to the drawings, in which:

FIG. 2 is a side view showing the flying saucer toy in FIG. 1;

FIG. 3 is a front view of the toy in FIG. 2;

FIG. 5 is a partly broken plan view particularly showing a pinch member incorporated in the pistol for a firing device, and FIG. 6 is a partly omitted front view showing a flying disk.

Figure 1:
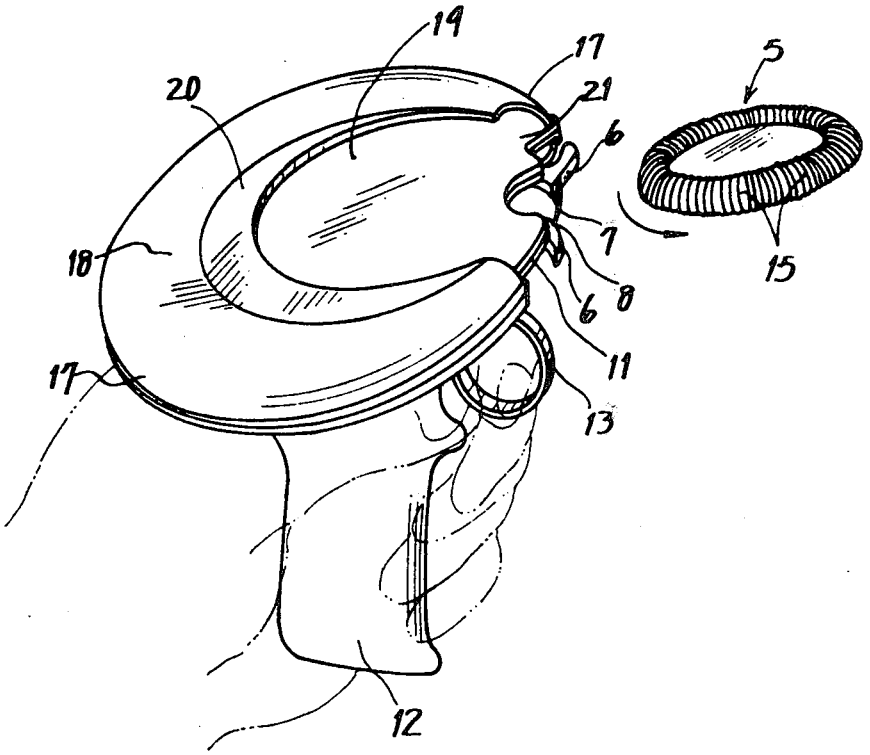
FIG. 1 is a perspective view showing the flying saucer toy according to the present invention.

Referring to FIG. 5, the pistol is provided with a pinch member 2 whose base portion 3 is secured to a lower plate 4, the pinch member including a pair of pinching blades 1 and 1' whose top each end 6 is outwardly bent. In the drawing the left-hand end is acutely bent or angulated while the right-hand end is loosely bent or curved so as to constitute a round slippery corner 8. On the other hand, the angulated corner constitutes an opposing corner 7 adapted to attentuate a thrust provided by the pinching blades to the disk. The pinching blades 1 and 1' are constantly subjected to an inward force provided by their own resiliency. Instead of producing the angulated corner 7, a normally curved corner may be initially made in the same manner as the corner 8, and then dentures may be cut or a sticky substance may be coated thereon, so as to impart a frictional or resisting nature thereto. A flying disk 5 is forced by a finger into an accommodation space 9 of the pinch member 2, defined by the pinching blades 1 and 1'. At this stage, the pinching blades are caused to expand against their inward urge, as indicated by the imaginary lines in FIG. 5.

The pinch member 2 is covered by an upper plate 11, which is placed opposedly to the lower plate 4. A handle 12 is fastened to the lower plate 4, and a trigger lever 13 is pivotally connected to the handle, wherein the trigger lever includes a pusher end 14 protruding between the pinching blades so as to release the loaded disk from the pinching blades.

Figure 4:
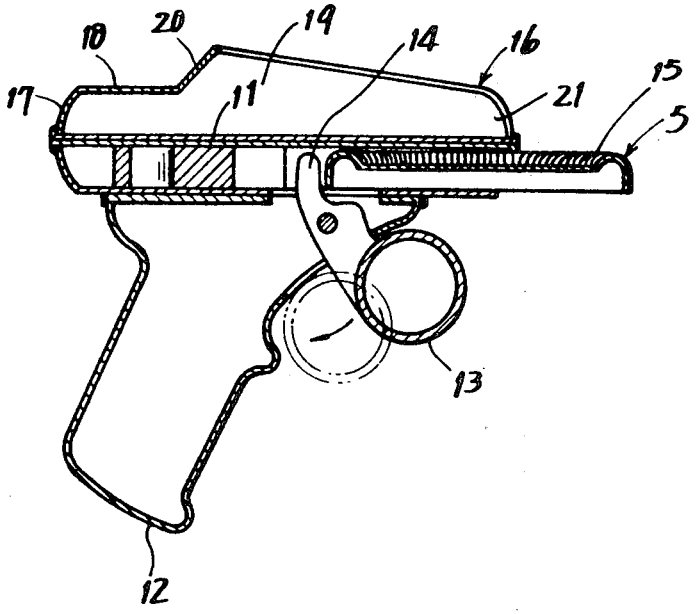
FIG. 4 is a cross-sectional view through the pistol loaded with a flying disk.

The flying disk 5 has an inwardly concave bottom, and is preferably provided with ridges 15 on its rim portion, as illustrated in FIGS. 4 and 6, so as to increase friction between the disk and the opposing corner 7.

In addition to the firing expedient referred to above, the pistol has a catching section 16, which is defined by a side wall 17 fastened to the upper plate 11. The catching section 16 includes a pocket or landing spot 19 in which the flying disk is caught, wherein the spot 19 is half covered by overhang 20 integral with the side wall 17 through a connecting part 18. The overhang 20 is slightly raised so as to secure the flying disk therein.

The spot 19 includes a port 21 from which the caught disk is taken out for a subsequent loading. When the caught disk is to be taken out of the pistol, the pistol has only to be tilted forwardly. The flying disk also can be caught through this port 21, or it may be caused to collide with the overhang 20, thereby allowing same to fall into the spot 19. The side wall 17 surrounds the spot 19 to the extend that the caught disk is difficult to accidentally dismount from the landing spot 19 during the play. In addition, the connecting part 18 is prolonged sufficiently to produce a relatively deep corner thereunder, as best illustrated in FIG. 4.

In operation, the disk 5 is forced into the space 9 of the pinch member 2 until it comes into abutment with the pusher end 14 of the trigger lever 13, thereby enabling the disk to stay therein under the compression provided by the pinching blades 1 and 1'. In this way the loading of the disk is finished. When the operator pulls the trigger lever 13 by his finger, the lever rotates around its pivot thereby to cause its pusher end 14 to push the loaded disk forwardly. However, the forwardly directed thrust is opposed by the angulated corner 7, and attenuates in its strength, but at the curved slippery corner 8 the thrust is allowed to pass smoothly. Because of the unbalanced application of thrust to the periphery of the disk, a torque occurs in the direction indicated by the arrow (a) in FIG. 5, wherein the torque functions as a firing impetus. The torque is accelerated by engagement of the ridges 15 on the disk 5 with the angulated corner 7.

The disk flying in the air is caught in the catching section 16 either by capturing the disk skillfully in the landing spot 19, or by making the disk collide with the overhang 20 and fall into the landing spot 19.

According to the present invention, the construction of the pistol is simplified, and accordingly inexpensive. In addition, the pistol functions not only as a firing device but also as a catching device. To catch the disk, the children have to run over a certain distance in following the disk along its flying course or running ahead of it by previous anticipation of the course. In either case they unconsciously have a good amount of exercise. The thrilling feeling will be amplified in running with the flying disk. Because of the simplified mechanism children can easily handle the pistol, and the toy can be reasonably inexpensive and trouble-free for children.

What is claimed is:

1. A flying saucer toy including a pistol for firing a flying disk, wherein said pistol includes a pair of resilient pinching blades adapted to hold said disk therebetween under compression, one said pinching blade having an opposing corner adjacent the free end thereof while the other blade has a slippery corner, said opposing corner and said slippery corner being opposedly located, said opposing corner being adapted to resist a thrust provided by said pinching blades to said disk while said slippery corner is adapted to allow said thrust to pass, thereby enabling a torque to be exerted on said disk as a firing impetus, said pistol further including a pocket defined by a side wall in which said disk can be caught during its flight, said flying disk having an inwardly concave bottom adapted to receive a lift efficiently, and means for releasing said disk from said pinching blades so as to fire said disk.

2. A flying saucer toy as claimed in claim 1, said pistol further including a pair of upper and lower plates for covering said pinching blades, said pinching blades having their base portion fixed to either of said upper or lower plates while their blade portions being free to move toward each other, said releasing means being pivotally connected to said lower plate.

3. A flying saucer toy as claimed in claim 1, wherein said releasing means is a trigger lever having its top end protruding between said pinching blades.

4. A flying saucer as claimed in claim 1, wherein said side wall has its front part broken through which the disk caught in said pocket can be taken out.

5. A flying saucer toy as claimed in claim 1, wherein said flying disk includes ridges on its rim portion.

6. A flying saucer toy as claimed in claim 1, wherein said side wall includes an overhang slightly raised with respect to said pocket.

* * * * *